US009316434B2

(12) United States Patent
Paradowski et al.

(10) Patent No.: US 9,316,434 B2
(45) Date of Patent: Apr. 19, 2016

(54) PROCESS FOR PRODUCING LIQUID AND GASEOUS NITROGEN STREAMS, A GASEOUS STREAM WHICH IS RICH IN HELIUM AND A DENITRIDED STREAM OF HYDROCARBONS AND ASSOCIATED INSTALLATION

(75) Inventors: Henri Paradowski, Pluvigner (FR); Sylvain Vovard, Courbevoie (FR)

(73) Assignee: TECHNIP FRANCE (FR)

( * ) Notice: Subject to any disclaimer, the term of this patent is extended or adjusted under 35 U.S.C. 154(b) by 700 days.

(21) Appl. No.: 13/122,765

(22) PCT Filed: Oct. 2, 2009

(86) PCT No.: PCT/FR2009/051884

§ 371 (c)(1),
(2), (4) Date: Jun. 6, 2011

(87) PCT Pub. No.: WO2010/040935

PCT Pub. Date: Apr. 15, 2010

(65) Prior Publication Data

US 2011/0226009 A1 Sep. 22, 2011

(30) Foreign Application Priority Data

Oct. 7, 2008 (FR) ..... 08 56788

(51) Int. Cl.

| | |
|---|---|
| ***F25J 1/02*** | (2006.01) |
| ***F25J 3/02*** | (2006.01) |
| ***F25J 1/00*** | (2006.01) |

(52) U.S. Cl.

CPC ..... *F25J 3/0233* (2013.01); *F25J 1/004* (2013.01); *F25J 1/005* (2013.01); *F25J 1/0022* (2013.01); *F25J 1/0042* (2013.01); *F25J 1/0045* (2013.01); *F25J 1/0072* (2013.01); *F25J 1/0208* (2013.01); *F25J 1/0219* (2013.01); *F25J 1/0265* (2013.01); *F25J 1/0267* (2013.01); *F25J 3/0209* (2013.01); *F25J 3/029* (2013.01); *F25J 3/0257* (2013.01); *F25J 2200/02* (2013.01); *F25J 2200/76* (2013.01); *F25J 2215/04* (2013.01); *F25J 2215/30* (2013.01); *F25J 2220/64* (2013.01); *F25J 2235/60* (2013.01); *F25J 2240/30* (2013.01); *F25J 2270/02* (2013.01); *F25J 2270/04* (2013.01); *F25J 2270/14* (2013.01); *F25J 2270/42* (2013.01)

(58) Field of Classification Search

USPC ..... 62/618, 620, 621, 623

See application file for complete search history.

(56) References Cited

U.S. PATENT DOCUMENTS 2,940,271 A * 6/1960 Jackson ..... 62/623
3,355,902 A * 12/1967 Crawford et al. ..... 62/639

(Continued)

*Primary Examiner* — John F Pettitt
*Assistant Examiner* — Tareq Alosh
(74) *Attorney, Agent, or Firm* — Ostrolenk Faber LLP

(57) ABSTRACT

This process includes the cooling of an introduction stream (72) inside an upstream heat exchanger (28). It includes the introduction of the cooled introduction stream (76) into a fractionating column (50) and the tapping at the bottom portion of the column (50) of the denitrided stream of hydrocarbons. It also includes the introduction of a stream (106) rich in nitrogen obtained from the head portion of the column (50) into a separation container (60) and the recovery of the head gaseous stream from the separation container (60) in order to form the stream (20) which is rich in helium. The liquid stream (110) is obtained from the bottom of the first separation container (60) is separated into a liquid nitrogen stream (18) and a first reflux stream (114) which is introduced as reflux into the head of the fractionating column (50).

11 Claims, 6 Drawing Sheets

(56) References Cited

U.S. PATENT DOCUMENTS

| | | | | | |
|---|---|---|---|---|---|
| 4,479,871 | A * | 10/1984 | Pahade | C10G 5/00 208/340 |
| 4,662,919 | A * | 5/1987 | Davis | 62/622 |
| 4,968,337 | A * | 11/1990 | Layland et al. | 62/645 |
| 5,345,773 | A * | 9/1994 | Nagamura et al. | 62/646 |
| 5,960,644 | A * | 10/1999 | Nagelvoort et al. | 62/622 |
| 6,298,688 | B1 * | 10/2001 | Brostow et al. | 62/613 |
| 2004/0231359 | A1 * | 11/2004 | Brostow et al. | 62/623 |
| 2007/0095099 | A1 * | 5/2007 | Paradowski | 62/600 |
| 2007/0245771 | A1 * | 10/2007 | Spilsbury | 62/620 |
| 2011/0174017 | A1 * | 7/2011 | Victory | F25J 3/0209 62/620 |

* cited by examiner

PROCESS FOR PRODUCING LIQUID AND GASEOUS NITROGEN STREAMS, A GASEOUS STREAM WHICH IS RICH IN HELIUM AND A DENITRIDED STREAM OF HYDROCARBONS AND ASSOCIATED INSTALLATION

CROSS REFERENCE TO RELATED APPLICATIONS

The present application is a 35 U.S.C. §371 National Phase conversion of PCT/FR2009/051884, filed Oct. 2, 2009, which claims benefit of French Application No. 0856788, filed Oct. 7, 2008, the disclosure of which is incorporated herein by reference. The PCT International Application was published in the French language.

BACKGROUND OF THE INVENTION

The present invention relates to a process for producing a liquid nitrogen stream, a gaseous nitrogen stream, a gaseous stream which is rich in helium and a denitrided stream of hydrocarbons from a feed stream which contains hydrocarbons, helium and nitrogen.

Such a process is used particularly for processing feed streams which are constituted by liquefied natural gas (LNG) or also natural gas (NG) in gaseous form.

This process is used for new units for liquefying natural gas or new units for processing natural gas in gaseous form. The invention also applies to improving the effectiveness of existing units.

In those installations, the natural gas must be denitrided before being conveyed to the consumer, or before being stored or transported. The natural gas extracted from underground deposits often contains a significant quantity of nitrogen. It further commonly contains helium.

Known denitriding processes allow production of a denitrided hydrocarbon stream which can be conveyed towards a storage unit in liquid form in the case of LNG or towards a gas distribution unit in the case of NG.

Those denitriding processes further produce streams which are rich in nitrogen and which are used either to provide the nitrogen necessary for the operation of the installation or to provide a combustible gas which is rich in nitrogen and which serves as a fuel for the gas turbines of the compressors which are used when the process is carried out. In a variant, those streams which are rich in nitrogen are released to the atmosphere in a flare stack after the impurities, such as methane, have been burnt off.

The above-mentioned processes are not entirely satisfactory, particularly because of the new environmental constraints being applied to the production of hydrocarbons. So that the nitrogen produced by the process can be used in the production unit or released to atmosphere, it must be very pure.

The fuel streams produced by the process and intended to be used in gas turbines must, however, contain less than from 15 to 30% of nitrogen in order to be burnt in special burners which are configured to limit the production of nitrogen oxides which are discharged to atmosphere. Those discharges are produced in particular during start-up phases of the installations which are used to carry out the process, wherein the denitriding process is not yet very efficient.

For economic reasons, the energy yield of such denitriding processes must further permanently be improved. The processes of the above-mentioned type do not allow the helium contained in the natural gas extracted from underground to be exploited, though helium is a rare gas having a high economic value.

In order to at least partially overcome those problems, US2007/0245771 describes a process of the above-mentioned type which simultaneously produces a stream of liquid nitrogen, a stream which is rich in helium and a gaseous stream containing approximately 30% of nitrogen and approximately 70% of hydrocarbons. That gaseous stream which is rich in nitrogen is intended, in this installation, to form a fuel stream.

However, this process is not completely satisfactory because the quantity of pure nitrogen produced is relatively low. The fuel stream further contains a high quantity of nitrogen which is not compatible with all existing gas turbines and which is capable of generating a large number of polluting emissions.

SUMMARY OF THE INVENTION

An object of the invention is to produce an economic denitriding process for a hydrocarbon feed stream which allows the nitrogen and helium contained in the feed stream to be exploited, whilst minimising emissions which are harmful to the environment.

To that end, the invention relates to a process of the above-mentioned type, comprising the following steps:

- expanding the feed stream in order to form an expanded feed stream;
- dividing the expanded feed stream into a first introduction stream and a second introduction stream;
- cooling the first introduction stream within an upstream heat exchanger by heat exchange with a gaseous refrigerant stream which is obtained by dynamic expansion in a cooling cycle in order to obtain a first cooled introduction stream;
- cooling the second introduction stream by means of a first downstream heat exchanger in order to form a second cooled introduction stream;
- introducing the first cooled introduction stream and the second cooled introduction stream into a fractionating column which comprises a plurality of theoretical fractionating stages;
- tapping at least one reboiling stream and circulating the reboiling stream in the first downstream heat exchanger in order to cool the second introduction stream;
- tapping, at the bottom of the fractionating column, a bottom stream which is intended to form the denitrided stream of hydrocarbons;
- tapping, at the head of the fractionating column, a head stream which is rich in nitrogen;
- reheating the head stream which is rich in nitrogen by means of at least one second downstream heat exchanger in order to form a reheated stream which is rich in nitrogen;
- tapping and expanding a first portion of the reheated stream which is rich in nitrogen in order to form the gaseous nitrogen stream;
- compressing a second portion of the reheated stream which is rich in nitrogen in order to form a compressed, recycled nitrogen stream, and cooling the compressed, recycled nitrogen stream by means of circulation through the first downstream heat exchanger and the or each second downstream heat exchanger;
- liquefying and partially expanding the recycled nitrogen stream in order to form an expanded nitrogen rich stream;

introducing at least a portion obtained from the expanded nitrogen rich stream into a first separation container;

recovering the gaseous head stream from the first separation container in order to form the helium rich stream;

recovering the liquid stream from the bottom of the first separation container and separating that liquid stream into a liquid nitrogen stream and a first reflux stream;

introducing the first reflux stream as reflux into the head of the fractionating column.

The process according to the invention may comprise one or more of the following features taken in isolation or in accordance with any technically possible combination:

the whole of the expanded nitrogen rich stream is introduced into the first separation container directly after the expansion thereof;

the nitrogen rich expanded stream is introduced into a second separation container which is positioned upstream of the first separation container, the head stream from the second separation container being introduced into the first separation container, at least a portion of the bottom stream of the second separation container being introduced as reflux into the head of the fractionating column;

the bottom stream of the second separation container is separated into a second reflux stream which is introduced into the fractionating column and a supplementary cooling stream, the supplementary cooling stream being mixed with the nitrogen rich head stream before it is introduced into the second downstream heat exchanger;

the operating pressure of the fractionating column is less than 5 bar, advantageously less than 3 bar;

the cooling cycle is a closed cycle of the inverted Brayton type, the process comprising the following steps:

reheating the refrigerant stream in a cycle heat exchanger up to substantially ambient temperature;

compressing the reheated refrigerant stream in order to form a compressed refrigerant stream, and refrigerant in the cycle heat exchanger by means of heat exchange with the reheated refrigerant stream from the first upstream heat exchanger in order to form a cooled, compressed refrigerant stream;

dynamically expanding of the cooled, compressed refrigerant stream in order to form the refrigerant stream, and introducing the refrigerant stream into the first upstream heat exchanger;

the cycle heat exchanger is formed by one of the downstream heat exchangers, the compressed refrigerant stream being cooled at least partially by heat exchange in the downstream heat exchanger with the nitrogen rich head stream from the head of the fractionating column;

the cooling cycle is a semi-open cycle, the process comprising the following steps:

tapping at least one fraction of the nitrogen rich recycled stream which is compressed at a first pressure in order to form a tapped stream which is rich in nitrogen;

cooling the nitrogen rich tapped stream which in a cycle heat exchanger in order to form a cooled, tapped stream;

dynamically expanding of the cooled, tapped stream from the cycle heat exchanger in order to form the refrigerating stream, and introducing the refrigerant stream into the upstream heat exchanger;

compressing the refrigerant stream from the upstream heat exchanger in a compressor and re-introducing that stream into the recycled nitrogen stream which is compressed at a second pressure less than the first pressure;

the feed stream is a gaseous stream, the process comprising the following steps:

liquefying the feed stream in order to form a liquid feed stream by means of introduction through a liquefying heat exchanger;

vaporising the denitrided stream of hydrocarbons from the bottom of the fractionating column by means of heat exchange with a gaseous stream which is from the feed stream in the liquefying heat exchanger;

the cooling provided by the vaporisation of the denitrided stream of hydrocarbons constitutes more than 90%, advantageously more than 98%, of the cooling necessary for liquefying the feed stream.

The invention also relates to an installation for producing a liquid nitrogen stream, a gaseous nitrogen stream (16), a gaseous stream which is rich in helium and a denitrided stream of hydrocarbons from a feed stream which contains hydrocarbons, nitrogen and helium, the installation comprising:

means for expanding of the feed stream in order to form an expanded feed stream;

means for dividing the expanded feed stream into a first introduction stream and a second introduction stream;

means for cooling the first introduction stream comprising an upstream heat exchanger and a cooling cycle, in order to obtain a first cooled introduction stream by means of heat exchange with a gaseous refrigerant stream which is obtained by dynamic expansion in the cooling cycle;

means for cooling the second introduction stream comprising a first downstream heat exchanger in order to form a second cooled introduction stream;

a fractionating column comprising a plurality of theoretical fractionating stages;

means for introducing the first cooled introduction stream and the second cooled introduction stream into the fractionating column;

means for tapping at least one reboiling stream and means for circulating the reboiling stream in the first downstream heat exchanger in order to cool the second introduction stream;

means for tapping, at the bottom of the fractionating column, a bottom stream which is intended to form the denitrided stream of hydrocarbons;

means for tapping, at the head of the fractionating column, an head stream which is rich in nitrogen;

means for reheating the nitrogen rich head stream comprising at least a second downstream heat exchanger in order to form a reheated stream which is rich in nitrogen;

means for tapping and expanding a first portion of the nitrogen rich reheated stream in order to form the gaseous nitrogen stream;

means for compressing a second portion of the nitrogen rich reheated stream in order to form a recycled nitrogen stream and means for cooling the compressed, recycled nitrogen stream by means of circulation through the first downstream heat exchanger and the or each second downstream heat exchanger;

means for partially liquefying and expanding the recycled nitrogen stream in order to form an expanded nitrogen rich stream;

a first separation container;

means for introducing at least a portion obtained from the expanded nitrogen rich stream into the first separation container;

means for recovering the gaseous head stream from the first separation container in order to form the helium rich stream;

means for recovering the liquid stream from the bottom of the first separation container and for separating that stream into a liquid nitrogen stream and a first reflux stream;

means for introducing the first reflux stream as reflux into the head of the fractionating column.

The installation according to the invention may comprise one or more of the following features, taken in isolation or in accordance with any technically possible combination:

it comprises means for introducing the whole of the expanded nitrogen rich stream into the first separation container;

it comprises a second separation container which is positioned upstream of the first separation container and means for introducing the expanded nitrogen rich stream into the second separation container, the installation comprising means for introducing the head stream from the second separation container into the first separation container and means for introducing at least a portion of the bottom stream of the second separation container as reflux into the head of the fractionating column.

BRIEF DESCRIPTION OF THE DRAWINGS

The invention will be better understood from a reading of the following description given purely by way of example and with reference to the appended drawings, in which.

DESCRIPTION OF PREFERRED EMBODIMENTS

Figure 1:
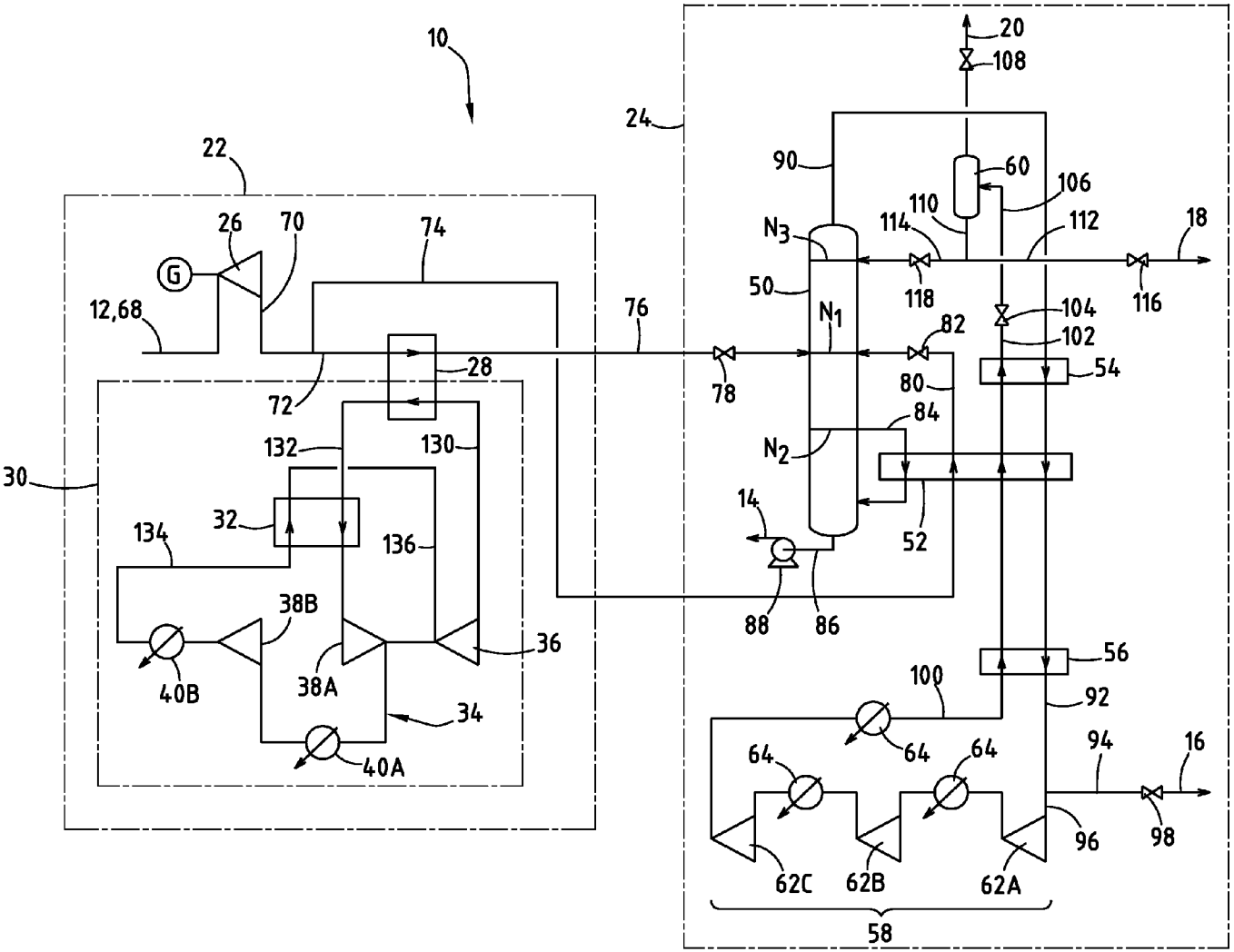
FIG. 1 is a schematic circuit diagram of a first installation for carrying out a first production process according to the invention.

FIG. 1 illustrates a first installation 10 according to the invention which is intended to produce, from a liquid feed stream 12 obtained from a feed of liquefied natural gas (LNG), a denitrided stream 14 of LNG which is rich in hydrocarbons, a gaseous nitrogen stream 16 which is intended to be used in the installation 10, a liquid nitrogen stream 18 and a stream 20 which is rich in helium.

As illustrated in FIG. 1, the installation 10 comprises an upstream portion 22 for cooling the feed and a downstream fractionating portion 24.

The upstream portion 22 comprises a liquid pressure reduction turbine 26, and an upstream heat exchanger 28 which is intended to cool the feed stream 12 by means of a cooling cycle 30.

In that example, the cooling cycle 30 is a closed cycle of the inverted Brayton type. It comprises a cycle heat exchanger 32, an upstream device 34 for compression in stages and a dynamic expansion turbine 36.

In the embodiment of FIG. 1, the upstream stage compression device 34 comprises two stages, each stage comprising a compressor 38A, 38B and a cooling device 40A, 40B which is cooled by air or water. At least one of the compressors 38A of the upstream device 34 is connected to the dynamic expansion turbine 36 in order to increase the efficiency of the process.

The downstream fractionating portion 24 comprises a fractionating column 50 which has a plurality of theoretical fractionating stages. The downstream portion 24 further comprises a first downstream heat exchanger 52 at the bottom portion of the column, a second downstream heat exchanger 54 and a third downstream heat exchanger 56.

The downstream portion 24 further comprises a downstream stage compression device 58 and a first separation container 60 at the head portion of the column.

In this embodiment, the downstream compression device 58 comprises three compression stages which are arranged in series, each stage comprising a compressor 62A, 62B, 62C which are placed in series with a cooling device 64A, 64B, 64C which is cooled by water or air.

A first production process according to the invention will now be described.

Hereinafter, a fluid stream and the conduit which conveys it will be referred to using the same reference numeral. Similarly, the pressures involved are absolute pressures, and, unless otherwise stated, the percentages involved are molar percentages.

In this embodiment, the liquid feed stream 12 is a stream of liquefied natural gas (LNG) comprising, in moles, 0.1009% of helium, 8.9818% of nitrogen, 86.7766% of methane, 2.9215% of ethane, 0.8317% of propane, 0.2307% of i-C4 hydrocarbons, 0.1299% of n-C4 hydrocarbons, 0.0128% of i-C5 hydrocarbons, 0.0084% of n-C5 hydrocarbons, 0.0005% of n-C6 hydrocarbons, 0.0001% of benzene, 0.0050% of carbon dioxide.

In this manner, this stream 12 comprises a molar content of hydrocarbons which is greater than 70%, a molar content of nitrogen of between 5% and 30% and a molar content of helium which is between 0.01% and 0.5%.

The feed stream 12 has a temperature which is less than −130° C., for example, less than −145° C. The stream has a pressure greater than 25 bar and in particular of 34 bar.

In the first embodiment, the feed stream 12 is liquid, so that it constitutes a liquid feed stream 68 which can be used directly in the process.

The liquid feed stream 68 is introduced into the liquid pressure reduction turbine 26, where it has its pressure reduced to a pressure below 15 bar, in particular of 6 bar, and to a temperature below −130° C. and in particular of −150.7° C.

At the outlet of the liquid pressure reduction turbine 26, an expanded feed stream 70 is formed. The expanded feed stream 70 is divided into a first main introduction stream 72 which is intended to be cooled by the cooling cycle 30 and a second secondary introduction stream 74.

The first introduction stream 72 has a mass flow which is greater than 10% of the feed stream 70 of reduced pressure. It is introduced into the upstream heat exchanger 28, where it is cooled to a temperature below −150° C. and in particular of −160° C., in order to provide a first cooled introduction stream 76.

In the upstream heat exchanger 28, the first introduction stream 72 is placed in a heat-exchange relationship with the refrigerant stream which flows in the cycle 30, as will be described below.

The first cooled introduction stream 76 is expanded in a first expansion valve 78 to a pressure below 3 bar, then it is introduced at an intermediate stage N1 of the fractionating column 50.

The second introduction stream 74 is conveyed as far as the first downstream heat exchanger 52 at the bottom of the column, where it is cooled to a temperature below −150° C., and in particular of −160° C., in order to provide a second cooled introduction stream 80.

The second cooled introduction stream 80 is expanded in a second expansion valve 82 to a pressure below 3 bar, then it is introduced at an intermediate stage N1 of the fractionating column 50.

In this embodiment, the first cooled introduction stream 76 and the second cooled introduction stream 80 are introduced at the same stage N1 of the column 50.

A re-boiling stream 84 is withdrawn from a lower stage N2 of the fractionating column 50 located below the intermediate stage N1. The re-boiling stream 84 passes into the first downstream bottom heat exchanger 52 in order to be placed in a heat exchange relationship with the second introduction stream 74 and to cool the second stream 74. Subsequently, it is re-introduced in the vicinity of the bottom of the fractionating column 50, below the lower stage N2.

The fractionating column 50 operates at low pressure, in particular less than 5 bar, advantageously less than 3 bar. In this embodiment, the column 50 operates substantially at 1.3 bar.

The fractionating column 50 produces a bottom stream 86 which is intended to form the denitrided stream 14 which is rich in LNG. The denitrided stream of LNG contains a controlled quantity of nitrogen, for example, of less than 1 mol %.

The bottom stream 86 is pumped at 5 bar in a pump 88 in order to form the denitrided stream 14 which is rich in hydrocarbons and in order to be conveyed towards a storage location operating at atmospheric pressure and to form the denitrided stream of LNG which is intended to be exploited. The stream 14 is a stream of LNG which can be conveyed in liquid form, for example, in a methane carrier.

The fractionating column 50 further produces a head stream 90 which is rich in nitrogen and which is extracted from the head of the column 50. The head stream 90 has a molar content of hydrocarbons that is advantageously less than 1%, and still more advantageously less than 0.1%. It has a molar content of helium greater than 0.2% and advantageously greater than 0.5%.

In the embodiment illustrated in FIG. 1, the molar composition of the head stream 90 is as follows: helium 0.54%, nitrogen 99.40% and methane 0.06%.

The nitrogen rich head stream 90 is successively passed into the second downstream heat exchanger 54, the first downstream heat exchanger 52, then the third downstream heat exchanger 56 in order to be successively reheated up to −20° C.

At the outlet of the third downstream heat exchanger 56, a reheated nitrogen rich stream 92 is obtained. The stream 92 is divided into a first lesser portion 94 of produced nitrogen and a second portion 96 of recycled nitrogen.

The lesser portion 94 has a mass flow rate of between 10% and 50% of the mass flow rate of the stream 92. The lesser portion 94 is expanded by means of a third expansion valve 98 in order to form the gaseous stream 16 of nitrogen.

The gaseous nitrogen stream 16 has a pressure greater than atmospheric pressure and particularly greater than 1.1 bar. It has a molar content of nitrogen greater than 99%.

The greater portion 96 is subsequently introduced into the downstream compression device 58, where it successively passes into each compression stage via a compressor 62A, 62B, 62C and a cooling device 64A, 64B, 64C.

The greater portion 96 is thereby compressed to a pressure greater than 20 bar and particularly substantially of 21 bar in order to form a compressed, recycled nitrogen stream 100.

The compressed, recycled nitrogen stream 100 thus has a temperature greater than 10° C. and particularly of 38° C.

The compressed, recycled nitrogen stream 100 successively passes through the third downstream heat exchanger 56, then through the first bottom downstream heat exchanger 52, and subsequently through the first downstream heat exchanger 54.

In the second downstream heat exchanger 54 and in the third downstream heat exchanger 56, the recycled nitrogen stream 100 flows in counter-stream and heat exchange relationship with the head nitrogen stream 90. In this manner, the head nitrogen stream 90 transfers frigories to the recycled nitrogen stream 100.

In the first bottom heat exchanger 52, the recycled nitrogen stream 100 is further placed in a heat exchange relationship with the reboiling stream 84 in order to be cooled by that stream 84.

After it has passed into the second downstream heat exchanger 54, the recycled nitrogen stream 100 forms a condensed recycled nitrogen stream 102 which is substantially liquid. The liquid stream contains a liquid fraction which is greater than 90% and has a temperature of less than −160° C. and advantageously of −170° C.

Subsequently, the condensed stream 102 is expanded in a fourth expansion valve 104 in order to provide a bi-phase flow 106 which is introduced into the first separation container 60.

The first separation container 60 produces, at the head portion, a gaseous head stream which is rich in helium and which, after it has been conveyed into a fifth expansion valve 108, forms the gaseous stream 20 which is rich in helium.

The helium rich gaseous stream 20 has a content of helium greater than 10 mol %. It is intended to be conveyed as far as a unit for producing pure helium in order to be processed at that location. The process according to the invention allows at least 60 mol % of the helium present in the feed stream 12 to be recovered.

The first separation container 60 produces, at the bottom portion, a bottom stream 110 of liquid nitrogen. The bottom stream 110 is separated into a lesser portion of liquid produced nitrogen 112 and a greater portion 114 of reflux nitrogen.

The lesser portion 112 has a mass flow rate which is less than 10% and particularly between 0% and 10% of the mass flow rate of the bottom stream 110. The lesser portion 112 is expanded in a sixth expansion valve 116 in order to form the produced stream 18 of liquid nitrogen. The produced nitrogen stream has a molar content of nitrogen which is greater than 99%.

The greater portion 114 is expanded to the column pressure by means of a seventh expansion valve 118 in order to form a first reflux stream, then it is introduced at an upper stage N3 of the fractionating column 50 located below the head of the column and above the intermediate stage N1. The molar fraction of nitrogen in the greater portion 114 is greater than 99%.

In the embodiment illustrated in FIG. 1, the cooling cycle 30 is a closed cycle of the inverted Brayton type, using an exclusively gaseous refrigerant stream.

In this embodiment, the refrigerant stream is formed by substantially pure nitrogen, whose nitrogen content is greater than 99%.

The refrigerant stream 130 supplied to the upstream heat exchanger 28 has a temperature which is less than −150° C. and particularly of −165° C., and a pressure greater than 5 bar and particularly of 9.7 bar. The refrigerant stream 130 flows via the cycle heat exchanger 32, where it is reheated by heat exchange with the first main introduction stream 72.

In this manner, the temperature of the reheated refrigerant stream 132 at the outlet of the upstream heat exchanger 28 is less than −150° C. and particularly of −153° C.

The reheated stream 132 is subjected to new reheating in the cycle heat exchanger 32 before being introduced into the series of compressors 38A, 38B and cooling devices 40A, 40B of the upstream stage compression device 34.

At the outlet of the upstream device 34, there is formed a compressed refrigerant stream 134 which is cooled by heat exchange with the reheated refrigerant stream 132 from the upstream heat exchanger 28 in the cycle heat exchanger 32.

The cooled compressed stream 136 thus has a pressure greater than 15 bar and particularly substantially of 20 bar and a temperature which is less than −130° C. and particularly substantially of −141° C.

The cooled, compressed stream 136 is subsequently introduced into the dynamic expansion turbine 36. It is subjected to dynamic expansion in the expansion turbine 36 in order to provide the refrigerant stream 130 at the temperature and pressure described above.

In an advantageous variant, the upstream and downstream compression devices 34 and 58 are integrated into the same machine having a plurality of bodies, with a single motor for driving the compressors 38A, 38B and the compressors 62A to 62C.

Examples of temperature, pressure and mass flow rates of the various streams illustrated in the process of FIG. 1 are set out in the Tables below.

| STREAM | TEMPERATURE (° C.) | PRESSURE (Bar) | FLOW RATE (Kg/h) |
|---|---|---|---|
| 12 | −149.5 | 34 | 177 365 |
| 70 | −150.7 | 6 | 177 365 |
| 76 | −160 | 6 | 135 142 |
| 80 | −160 | 6 | 42 223 |
| 84 | −163.6 | 1.4 | 168 931 |
| 86 | −159.7 | 1.4 | 154 923 |
| 14 | −159.5 | 5 | 154 923 |
| 90 | −193.4 | 1.3 | 55 761 |
| 92 | −20 | 1.3 | 55 761 |
| 16 | −20.4 | 1.1 | 20 219 |
| 100 | 38 | 21 | 35 541 |
| 106 | −173 | 9 | 35 541 |
| 20 | −180.5 | 4 | 1 663 |
| 18 | −182 | 4 | 560 |
| 114 | −173 | 9 | 33 319 |
| 130 | −165 | 9.7 | 86 840 |
| 132 | −153 | 9.7 | 86 840 |
| 136 | −141.5 | 19.5 | 86 840 |

Figure 2:
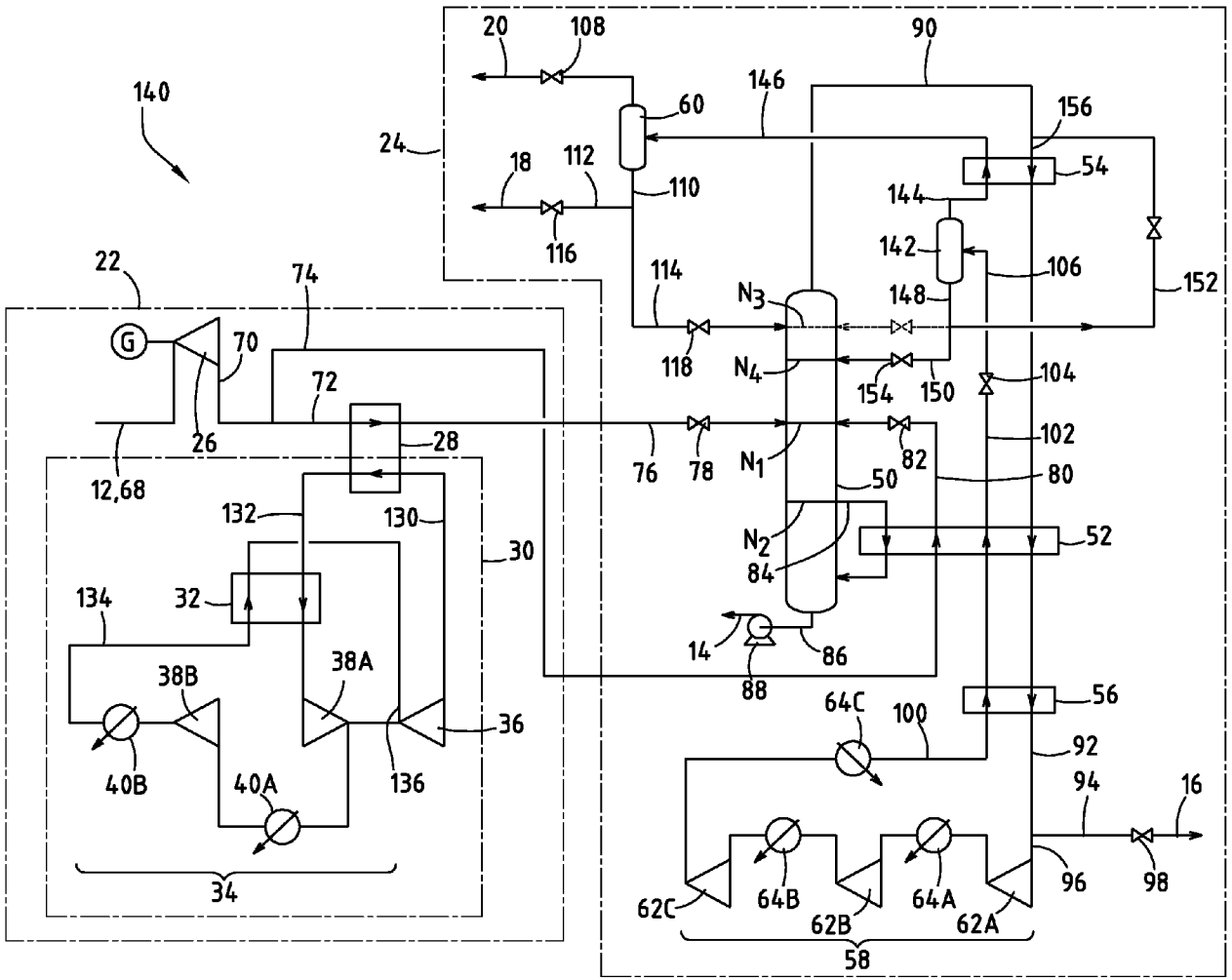
FIG. 2 is a view similar to FIG. 1 of a second installation for carrying out a second production process according to the invention.

The energy consumption of the process is as follows:
Compressor 62A: 1300 kW
Compressor 62B: 1358 kW
Compressor 62C: 1365 kW
Compressor 38B: 2023 kW
Total: 6046 kW A second installation 140 according to the invention is illustrated in FIG. 2. The second installation 140 is intended for carrying out a second production process according to the invention.

The installation 140 differs from the first installation 10 in that it comprises a second separation container 142 which is interposed between the outlet of the fourth expansion valve 104 and the inlet of the first separation container 60.

The second process according to the invention differs from the first process in that only a portion of the bi-phase flow 106 resulting from the expansion of the cooled, recycled nitrogen stream 102 in the fourth expansion valve 104 is received in the first separation container 60.

In this manner, the bi-phase flow 106 formed at the outlet of the fourth expansion valve 104 is introduced into the second separation container 142 and not directly into the first separation container 60. The cooled nitrogen stream 102 further does not pass through the second downstream heat exchanger 54.

The head flow 144 produced in the second separation container 142 is conveyed through the second downstream heat exchanger 54 in order to be cooled therein, then it is introduced in the form of a cooled head flow 146 into the first separation container 60.

The bottom flow 148 which is taken from the bottom of the second separation container 142 is divided into a second reflux nitrogen stream 150 and a supplementary cooling stream 152.

The second reflux nitrogen stream 150 is introduced, after expansion in an eighth expansion valve 154, at an upper stage N4 of the fractionating column 50 located beside and below the introduction stage N3 of the first reflux stream 114, into the fractionating column 50.

In a variant illustrated with broken lines in FIG. 2, the reflux streams 114, 150 are introduced at the same upper stage N3 of the column 50.

The mass flow rate of the second reflux stream 150 is greater than 90% of the mass flow rate of the bottom flow 148.

The second supplementary cooling stream 152 is reintroduced into the head stream 90 upstream of the second downstream heat exchanger 54 in order to provide frigories which are intended to cool and partially condense the head flow 144 which is conveyed into the second downstream heat exchanger 54.

The mixed stream 156 which results from the mixture of the head stream 90 and the supplementary cooling stream 152 is successively introduced into the second downstream heat exchanger 54, then into the first downstream heat exchanger 52 where it becomes involved in a heat exchange relationship with the recycled nitrogen stream 100 and the second introduction stream 74 in order to cool those streams.

The second process according to the invention is further operated in a similar manner to the first process according to the invention.

In this process, the feed stream 12 is a stream of liquefied natural gas (LNG) comprising a composition identical to that described above.

In the embodiment illustrated in FIG. 2, the molar composition of the head stream 90 is as follows: helium 0.54%, nitrogen 99.35% and methane 0.11%.

Examples of temperature, pressure and mass flow rates of the various streams illustrated in the process of FIG. 2 are set out in the Tables below.

| STREAM | TEMPERATURE (° C.) | PRESSURE (Bar) | FLOW RATE (Kg/h) |
|---|---|---|---|
| 12 | −149.5 | 34 | 177 365 |
| 70 | −150.7 | 6 | 177 365 |
| 76 | −160 | 6 | 134 400 |
| 80 | −160 | 6 | 43 150 |
| 84 | −163.6 | 1.4 | 169 069 |
| 86 | −159.7 | 1.4 | 155 100 |
| 14 | −159.5 | 5 | 155 100 |
| 90 | −193.4 | 1.3 | 52 390 |
| 92 | −32 | 1.3 | 52 678 |
| 16 | −32.1 | 1.1 | 22 140 |
| 100 | 38 | 19.7 | 30 550 |
| 106 | −180 | 5 | 30 550 |
| 146 | −186 | 4.7 | 3 940 |
| 150 | −179.8 | 5 | 26 320 |
| 152 | −179.8 | 5 | 288 |
| 20 | −186.3 | 4.7 | 271 |
| 18 | −186.3 | 4.7 | 28 |
| 114 | −186.3 | 4.7 | 3 640 |
| 130 | −163 | 9.7 | 112 100 |
| 132 | −154 | 9.7 | 112 100 |
| 136 | −140 | 19.2 | 112 100 |

Figure 3:
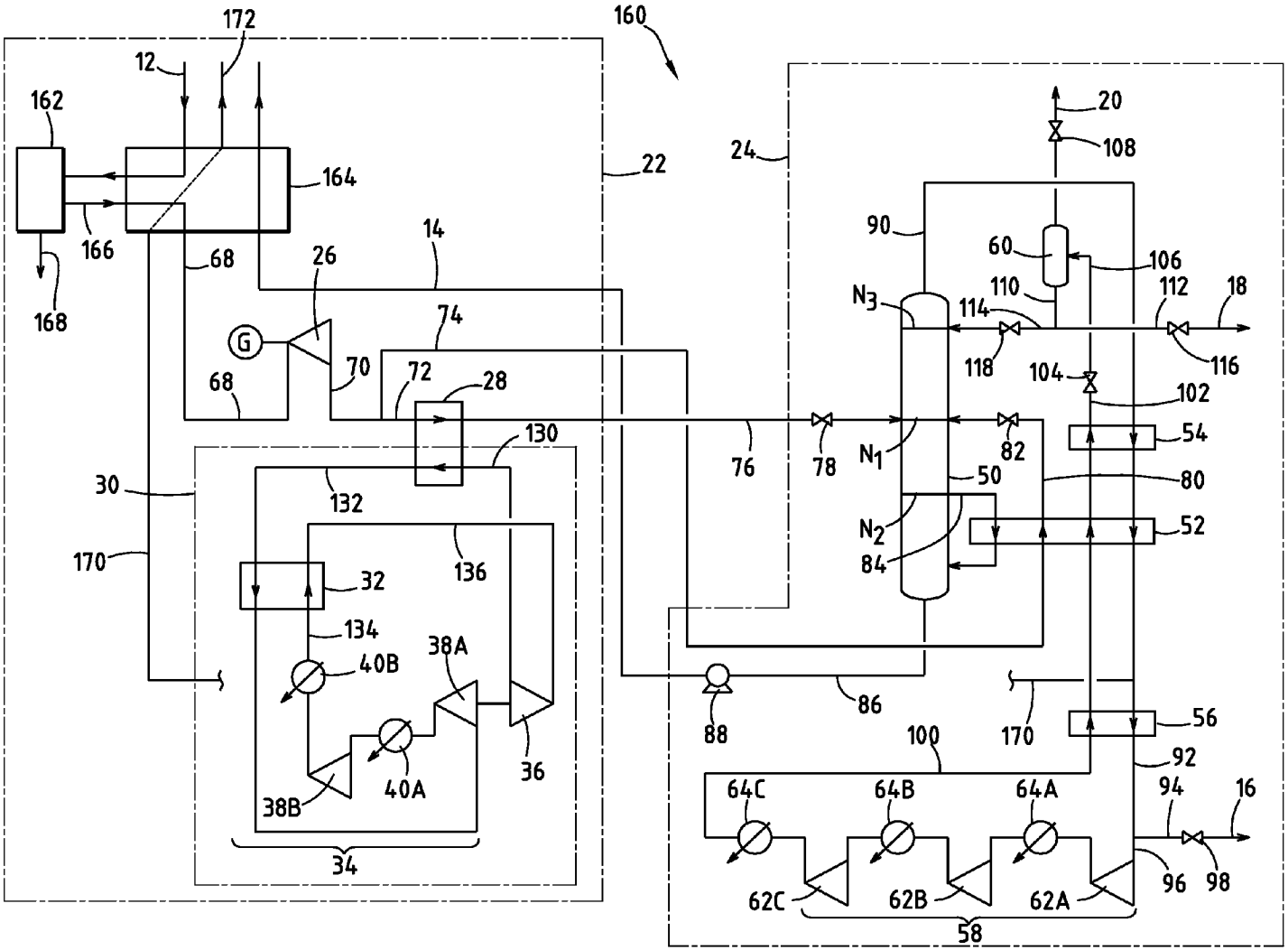
FIG. 3 is a view similar to FIG. 1 of a third installation for carrying out a third production process according to the invention.

The energy consumption of the process is as follows:
Compressor 62A: 1482 kW
Compressor 62B: 912 kW
Compressor 62C: 708 kW
Compressor 38B: 2584 kW
Total: 5686 kW A third installation 160 according to the invention for carrying out a third process according to the invention is illustrated in FIG. 3.

The third installation 160 differs from the first installation 10 owing to the provision of a fractionating portion 162 and an upstream liquefying heat exchanger 164 which are positioned upstream of the liquid pressure reduction turbine 26.

In that example, the feed stream 12 is natural gas (NG) in gaseous form. It is firstly introduced into the liquefying heat exchanger 164 in order to be cooled to a temperature which is less than −20° C. and substantially of −30° C.

The feed stream 12 is then conveyed to the fractionating portion 162 which produces a processed gas 166 having a low content of $C_5^+$ hydrocarbons and a fraction 168 of liquefied gas which is rich in $C_5^+$ hydrocarbons. The molar content of $C_5^+$ hydrocarbons in the processed gas 166 is less than 300 ppm.

The processed gas 166 is reintroduced into the liquefying heat exchanger 164 in order to be liquefied and to provide a liquid feed stream 68 at the outlet of the liquefying heat exchanger 164.

Since the processed gas 166 does not have any heavy constituents, such as benzene, whose crystallization temperature is high, it may readily be liquefied and does not involve any risk of plugging in the liquefying heat exchanger 164.

In order to provide the frigories necessary for cooling the feed stream 12 and the processed gas 166, the third process according to the invention comprises the passage of the denitrided stream 14 which is rich in hydrocarbons through the heat exchanger 164 after it has passed through the pump 88.

To that end, the bottom liquid stream 86 of the fractionating column 50 is pumped to a pressure which is greater than 20 bar, advantageously greater than 28 bar, in order to be vaporised in the liquefying heat exchanger 164 and to allow the feed stream 12 to be cooled and the processed gas 166 to be liquefied.

The cooling provided by the vaporisation of the denitrided stream of hydrocarbons 14 constitutes more than 90%, advantageously more than 98%, of the cooling necessary for liquefying the feed stream 12.

Similarly, a tapping stream 170 is tapped from the nitrogen stream 102 after it has passed into the downstream bottom heat exchanger 52 and before it is introduced into the third downstream heat exchanger 56. The tapping stream 170 is subsequently introduced into the liquefying heat exchanger 164 before being supplied in the form of an auxiliary gaseous nitrogen stream 172 to the outlet of the heat exchanger 164.

The mass flow rate of the tapping fraction 170 in relation to the mass flow rate of the head stream 90 which is rich in nitrogen is, for example, between 0% and 50%.

The third process according to the invention further operates in a manner similar to the first process according to the invention.

In this embodiment, the feed stream 12 is a natural gas stream in gaseous form comprising, in moles, 0.1000% of helium, 8.9000% of nitrogen, 85.9950% of methane, 3.0000% of ethane, 1.0000% of propane, 0.4000% of i-C4 hydrocarbons, 0.3000% of n-C4 hydrocarbons, 0.1000% of i-C5 hydrocarbons, 0.10000% of n-C5 hydrocarbons, 0.0800% of n-C6 hydrocarbons, 0.0200% of benzene, 0.0050% of carbon dioxide.

The liquid feed stream 68 comprises the same composition as the LNG stream 12 described for the first and second processes according to the invention.

In the embodiment illustrated in FIG. 3, the molar composition of the head stream 90 is as follows: helium 1.19%, nitrogen 98.64% and methane 0.16%.

Examples of temperature, pressure and mass flow rates of the various streams illustrated in the process of FIG. 3 are set out in the Tables below.

| STREAM | TEMPERATURE (° C.) | PRESSURE (Bar) | FLOW RATE (Kg/h) |
|---|---|---|---|
| 12 | 38 | 40 | 182 700 |
| 166 | −38 | 35 | 177 470 |
| 68 | −152 | 34 | 177 470 |
| 70 | −152.8 | 6 | 177 470 |
| 76 | −159.5 | 6 | 139 733 |
| 80 | −160 | 6 | 37 779 |
| 84 | −161.5 | 2.7 | 174 559 |
| 86 | −158.3 | 2.7 | 165 811 |
| 14 | −157.2 | 28 | 165 811 |
| 90 | −186.7 | 2.6 | 24 896 |
| 92 | −20 | 2.6 | 24 896 |
| 16 | −20.7 | 2.5 | 11 083 |
| 100 | 38 | 39.7 | 13 813 |
| 106 | −177 | 9 | 13 813 |
| 20 | −180.41 | 5 | 370 |
| 18 | −179.8 | 5 | 248 |
| 114 | −176.9 | 9 | 13 195 |
| 130 | −165.8 | 9.7 | 61 629 |
| 132 | −155 | 9.7 | 61 629 |
| 136 | −143 | 19.2 | 61 629 |

Figure 4:
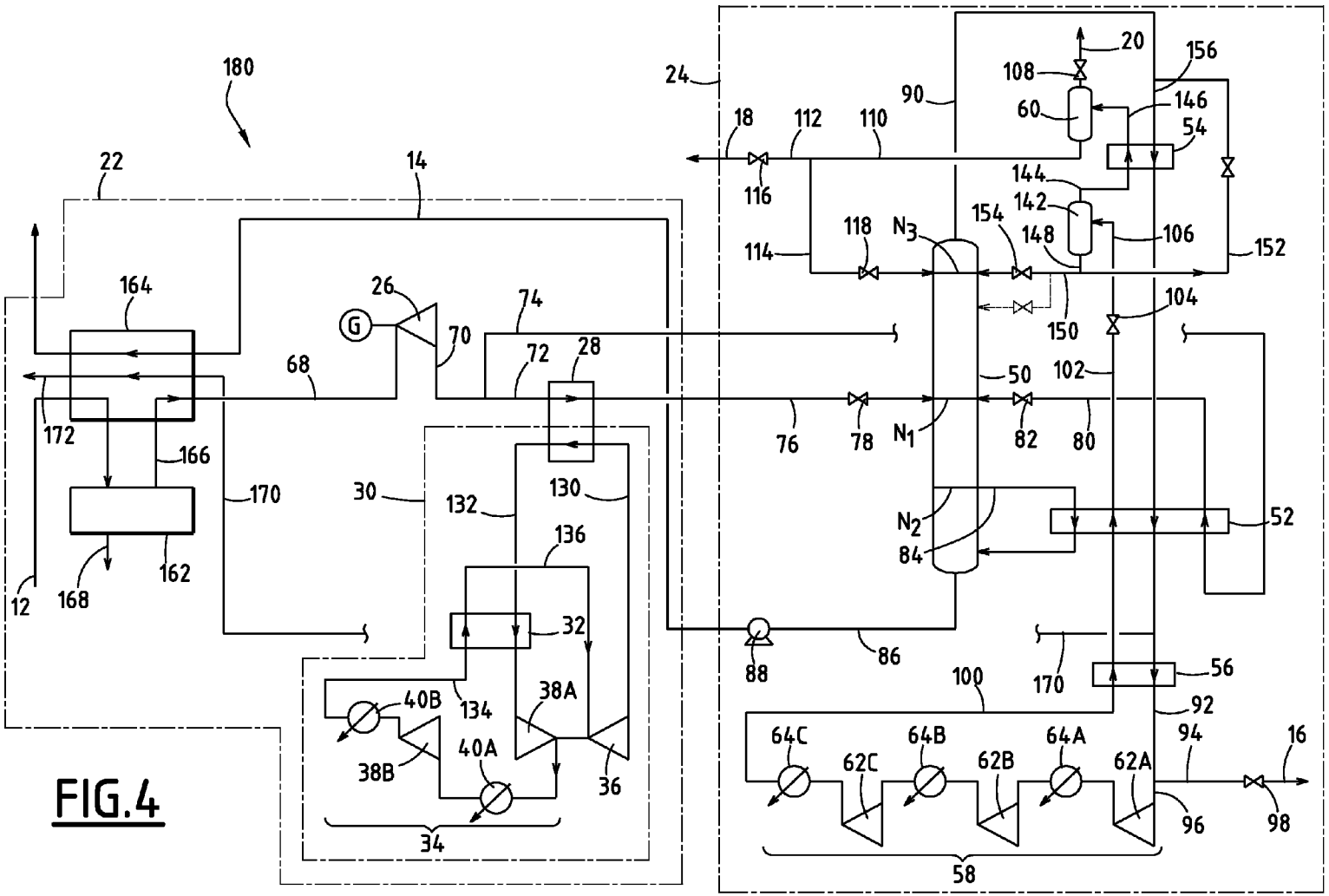
FIG. 4 is a view similar to FIG. 1 of a fourth installation for carrying out a fourth production process according to the invention.

The energy consumption of the process is as follows:
Compressor 62A: 632 kW
Compressor 62B: 388 kW
Compressor 62C: 325 kW
Compressor 38B: 1440 kW
Total: 2785 kW A fourth installation 180 according to the invention, intended for carrying out a fourth process according to the invention, is illustrated in FIG. 4. The fourth installation 180 differs from the third installation 170 owing to the provision of two separation containers 60, 142, as in the second installation.

Its operation is further similar to that of the third installation 160.

Figure 5:
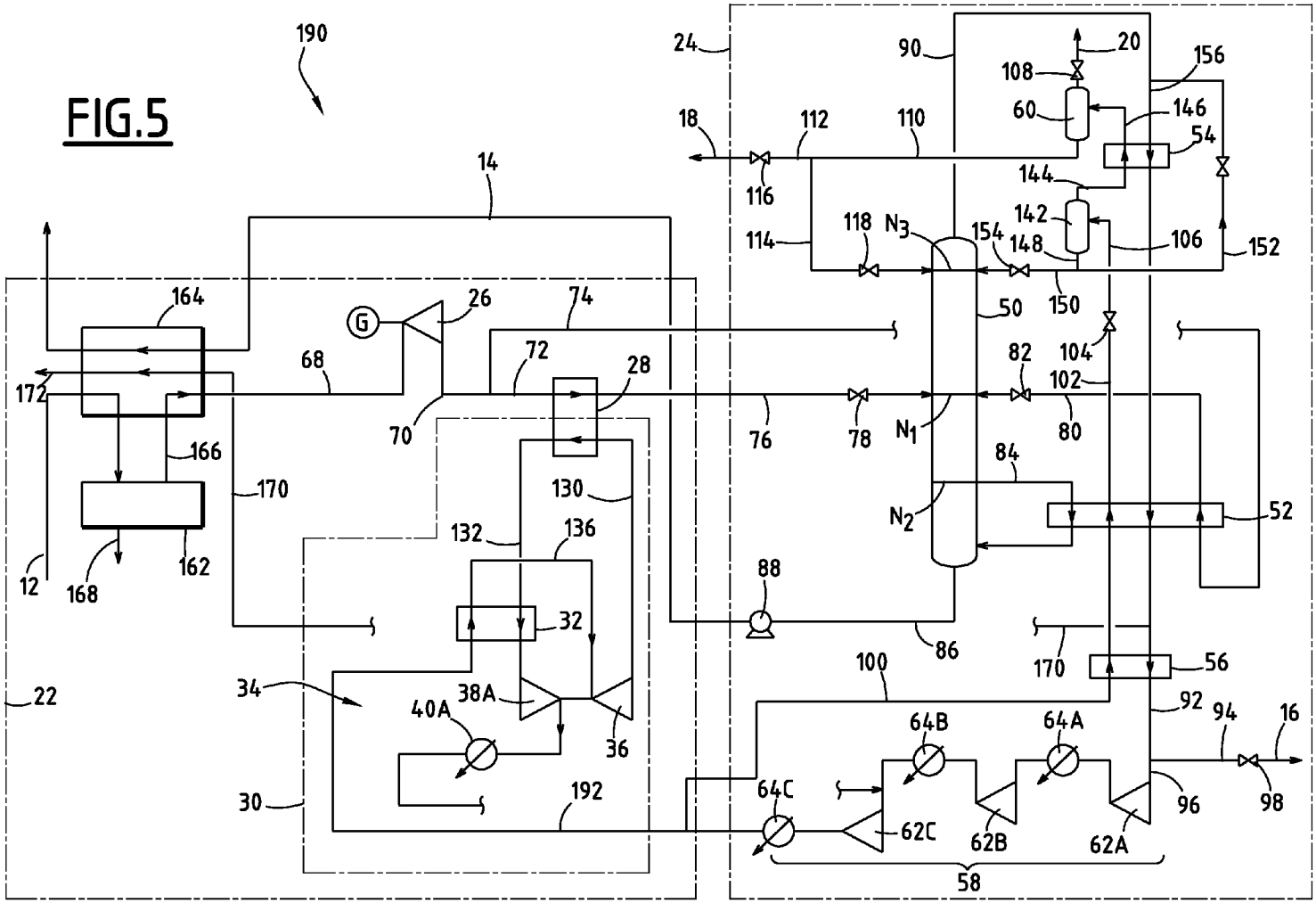
FIG. 5 is a view similar to FIG. 1 of a fifth installation for carrying out a fifth production process according to the invention.

A fifth installation 190 according to the invention is illustrated in FIG. 5, for carrying out a fifth process according to the invention.

The fifth installation 190 differs from the fourth installation 180 in that the cooling cycle 30 is a semi-open cycle. To that end, the refrigerant fluid of the cooling cycle 30 is formed by a branch stream 192 of the compressed, recycled nitrogen stream 100 tapped at the outlet of the upstream compression device 58, at a first pressure P1 which is substantially 40 bar.

The mass flow rate of the branch stream 192 is less than 99% of the mass flow rate of the greater portion 96.

The branch stream 192 is introduced into the cycle heat exchanger 32 in order to form, at the outlet of the heat exchanger 32, the cooled, compressed stream 136 then, after expansion in the turbine 36, the refrigerant stream 130 is introduced into the upstream heat exchanger 28.

The refrigerant stream 130 thus has a molar content of nitrogen greater than 99% and a content of hydrocarbons less than 0.1%.

After it has passed into the heat exchanger 32, the reheated refrigerant stream 132 is introduced into the compressor 38A which is connected to the turbine 36, then into the cooling device 40A, before being reintroduced into the compressed, recycled nitrogen stream 100, between the penultimate stage and the last stage of the compression device 58, at a second pressure P2 which is less than the first pressure P1.

Figure 6:
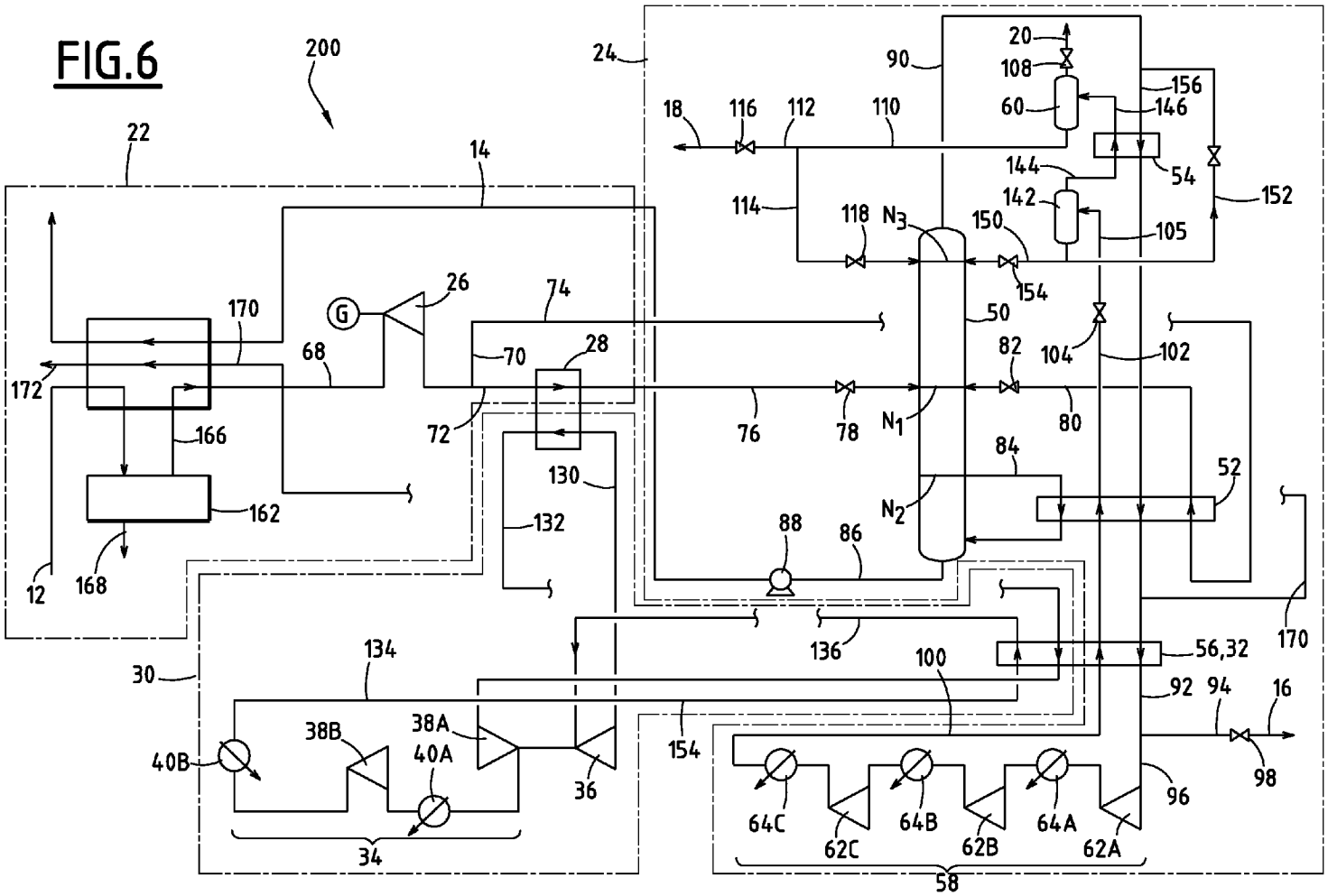
FIG. 6 is a view similar to FIG. 1 of a sixth installation for carrying out a sixth production process according to the invention.

A sixth installation 200 according to the invention is illustrated in FIG. 6.

The sixth installation 200 according to the invention differs from the fourth installation 180 in that the cycle heat exchanger 32 is constituted by the same heat exchanger as the third downstream heat exchanger 56.

The reheated refrigerant stream 132 from the upstream heat exchanger 28 is introduced into the third downstream heat exchanger 56 where it is placed in a heat exchange relationship with the mixing stream 156 from the second downstream heat exchanger 52 and the compressed, recycled nitrogen stream 100 from the downstream compression device 58.

Similarly, the compressed refrigerant stream 134 is introduced into the third downstream heat exchanger 56 in order to be cooled before it is introduced into the dynamic expansion reduction turbine 36.

The operation of the sixth process according to the invention is further similar to that of the fourth process according to the invention.

Owing to the processes according to the invention, it is possible to produce, in a flexible and economical manner, substantially pure gaseous nitrogen 16, substantially pure liquid nitrogen 18 and a stream 20 which is rich in helium which can be subsequently utilised in a helium production works.

The process further produces a stream 14 which is rich in denitrided hydrocarbon which can be used in liquid or gaseous form.

All the fluids produced by the process are therefore able to be used and utilised in that state.

It is equally possible to use this process with a feed stream 12 which is constituted by liquefied natural gas or natural gas in gaseous form.

The quantity of liquid nitrogen 18 produced by the process can be controlled simply by regulating the thermal power taken by the second introduction stream 72 from the refrigerant stream 130 of the cooling cycle 30.

What is claimed is:

1. A method of producing a liquid nitrogen stream, a gaseous nitrogen stream, a gaseous stream which is rich in helium and a denitrided stream of hydrocarbons from a feed stream which contains hydrocarbons, nitrogen and helium, the method comprising the following steps:

expanding the feed stream in order to form an expanded feed stream;

dividing the expanded feed stream into a first introduction stream and a second introduction stream;

cooling the first introduction stream within an upstream heat exchanger by heat exchange with a gaseous refrigerant stream which is obtained by dynamic expansion in a cooling cycle in order to obtain a first cooled introduction stream;

forming a second cooled introduction stream by cooling, using a first downstream heat exchanger, the second introduction stream;

introducing the first cooled introduction stream and the second cooled introduction stream into a fractionating column which comprises a plurality of theoretical fractionating stages;

tapping at least one reboiling stream and circulating the reboiling stream in the first downstream heat exchanger in order to cool the second introduction stream;

tapping, at a bottom of the fractionating column, a bottom stream which forms the denitrided stream of hydrocarbons;

tapping, at a head of the fractionating column, a head stream which is rich in nitrogen;

reheating the head stream by at least one second downstream heat exchanger in order to form a reheated stream which is rich in nitrogen;

tapping and expanding a first portion of the reheated stream in order to form the gaseous nitrogen stream;

compressing a second portion of the reheated stream in order to form a compressed, recycled nitrogen stream, and cooling the compressed, recycled nitrogen stream by circulation through the first downstream heat exchanger and/or each second downstream heat exchanger;

liquefying and partially expanding the recycled nitrogen stream in order to form an expanded nitrogen rich stream;

introducing at least a portion obtained from the expanded nitrogen rich stream into a first separation container;

recovering the gaseous head stream from the first separation container in order to form the helium rich stream;

recovering the liquid stream from the bottom of the first separation container and separating the recovered liquid stream into a liquid nitrogen stream and a first reflux stream;

introducing, as reflux, the first reflux stream into the head of the fractionating column;

introducing the nitrogen rich expanded stream upstream of the second downstream heat exchanger into a second separation container positioned upstream of the first separation container and upstream of the second downstream heat exchanger;

introducing the head stream from the second separation container successively into the second heat exchanger and into the first separation container, wherein the introducing of the head stream from the second separation container into the first separation container is performed without the head stream being expanded in any expansion device; and introducing, as reflux, at least a portion of the bottom stream of the second separation container into the head of the fractionating column.

2. The method according to claim 1, further comprising: separating the bottom stream of the second separation container into a second reflux stream which is introduced into the fractionating column and a supplementary cooling stream; and mixing the supplementary cooling stream with the nitrogen rich head stream, and thereafter introducing the supplementary cooling stream and the nitrogen rich head stream mixture into the second downstream heat exchanger.

3. The method according to claim 2, wherein an operating pressure of the fractionating column is less than 5 bar.

4. The method according to claim 1, wherein the cooling cycle is a closed cycle and is an inverted Brayton cycle, the method comprising the following steps:

reheating the refrigerant stream in a cycle heat exchanger up to ambient temperature;

compressing the reheated refrigerant stream in order to form a compressed refrigerant stream, and refrigerant in the cycle heat exchanger by heat exchange with the reheated refrigerant stream from the upstream heat exchanger in order to form a cooled, compressed refrigerant stream; and dynamically expanding of the cooled, compressed refrigerant stream in order to form the refrigerant stream, and introducing the refrigerant stream into the first upstream heat exchanger.

5. The method according to claim 4, wherein the cycle heat exchanger is formed by one downstream heat exchange of the downstream heat exchangers, the compressed refrigerant stream being cooled at least partially by heat exchange in the one downstream heat exchanger with the nitrogen rich head stream from the head of the fractionating column.

6. The method according to claim 1, wherein the cooling cycle is a semi-open cycle, the method comprising the following steps:

tapping at least one fraction of the recycled nitrogen stream which is compressed at a first pressure in order to form a tapped stream which is rich in nitrogen;

cooling the nitrogen rich tapped stream in a cycle heat exchanger in order to form a cooled, tapped stream;

dynamically expanding the cooled, tapped stream from the cycle heat exchanger in order to form the refrigerating stream, and introducing the refrigerant stream into the upstream heat exchanger; and compressing the refrigerant stream from the upstream heat exchanger in a compressor and re-introducing that stream into the recycled nitrogen stream which is compressed at a second pressure less than the first pressure.

7. The method according to claim 1, wherein the feed stream is a gaseous stream, the process comprising the following steps:

liquefying the feed stream in order to form a liquid feed stream by introduction through a liquefying heat exchanger, vaporising the denitrided stream of hydrocarbons from the bottom of the fractionating column by heat exchange with a gaseous stream which is from the feed stream in the liquefying heat exchanger.

8. An installation configured to produce a liquid nitrogen stream, a gaseous nitrogen stream, a gaseous stream which is rich in helium and a denitrided stream of hydrocarbons, the installation comprising:

an expansion unit configured to form an expanded feed stream by expanding a feed stream containing hydrocarbons, nitrogen a helium;

a dividing unit configured to divide the expanded feed stream into a first introduction stream and a second introduction stream;

a first introduction stream cooling unit configured to cool the first introduction stream, the first introduction stream cooling unit comprising an upstream heat exchanger and a cooling cycle, in order to obtain a first cooled introduction stream by heat exchange with a gaseous refrigerant stream which is obtained by dynamic expansion in the cooling cycle;

a second introduction stream cooling unit configured to cool the second introduction stream, the second introduction stream cooling unit comprising a first downstream heat exchanger in order to form a second cooled introduction stream;

a fractionating column comprising a plurality of theoretical fractionating stages;

a cooled stream introducer configured to introduce the first cooled introduction stream and the second cooled introduction stream into the fractionating column;

a reboiling stream tapper configured to tap at least one reboiling stream and a circulator configured to circulate the reboiling stream in the first downstream heat exchanger in order to cool the second introduction stream;

a bottom tapper positioned at the bottom of the fractionating column and configured to tap a bottom stream to form the denitrided stream of hydrocarbons;

a head tapper positioned at the head of the fractionating column and configured to tap a head stream which is rich in nitrogen;

a reheating unit configured to reheat the nitrogen rich head stream and comprising at least a second downstream heat exchanger in order to form a reheated stream which is rich in nitrogen;

a tapper and expander configured to tap and to expand a first portion of the nitrogen rich reheated stream in order to form the gaseous nitrogen stream;

a compressor configured to compress a second portion of the nitrogen rich reheated stream in order to form a recycled nitrogen stream and a cooling unit configured to cool the compressed, recycled nitrogen stream by circulation through the first downstream heat exchanger and/or each second downstream heat exchanger;

a liquefier and expander configured to partially liquify and expand the recycled nitrogen stream in order to form an expanded nitrogen rich stream;

a first separation container;

a first separation container introducer configured to introduce at least a portion obtained from the expanded nitrogen rich stream into the first separation container;

a gas recovery unit configured to recover the gaseous head stream from the first separation container in order to form the helium rich stream;

a liquid recovery unit configured to recover the liquid stream from the bottom of the first separation container and to separate the recovered liquid stream into a liquid nitrogen stream and a first reflux stream;

a reflux stream introducer configured to introduce, as reflux, the first reflux stream into the head of the fractionating column;

a second separation container positioned upstream of the first separation container and upstream of the second downstream heat exchanger;

an expansion unit configured to expand nitrogen rich stream into the second separation container upstream of the second downstream heat exchanger;

a head stream introducer configured to introduce the head stream from the second separation container successively into the second downstream heat exchanger and into the first separation container, wherein the introducing of the head stream from the second separation container into the first separation container is performed without the head stream being expanded in any expansion device; and a reflux introducer configured to introduce, as reflux, at least a portion of the bottom stream of the second separation container into the head of the fractionating column.

9. The method according to claim 2, wherein the operating pressure of the fractionating column is less than 3 bar.

10. A method of producing a liquid nitrogen stream, a gaseous nitrogen stream, a gaseous stream which is rich in helium and a denitrided stream of hydrocarbons from a feed stream which contains hydrocarbons, nitrogen and helium, the method comprising:

expanding the feed stream so as to form an expanded feed stream;

dividing the expanded feed stream into a first introduction stream and a second introduction stream;

cooling the first introduction stream within an upstream heat exchanger by heat exchange with a gaseous refrigerant stream which is obtained by dynamic expansion in a cooling cycle so as to obtain a first cooled introduction stream;

cooling the second introduction stream by a first downstream heat exchanger so as to form a second cooled introduction stream;

introducing the first cooled introduction stream and the second cooled introduction stream into a fractionating column which comprises a plurality of theoretical fractionating stages;

tapping at least one reboiling stream and circulating the reboiling stream in the first downstream heat exchanger so as to cool the second introduction stream;

tapping, at a bottom of the fractionating column, a bottom stream which forms the denitrided stream of hydrocarbons;

tapping, at a head of the fractionating column, a head stream which is rich in nitrogen;

reheating the head stream by at least one second downstream heat exchanger in order to form a reheated stream which is rich in nitrogen;

tapping and expanding a first portion of the reheated stream so as to form the gaseous nitrogen stream;

compressing a second portion of the reheated stream in order to form a compressed, recycled nitrogen stream, and cooling the compressed, recycled nitrogen stream by circulation through the first downstream heat exchanger and/or each second downstream heat exchanger;

liquefying and partially expanding the recycled nitrogen stream so as to form an expanded nitrogen rich stream;

introducing at least a portion obtained from the expanded nitrogen rich stream into a first separation container;

recovering the gaseous head stream from the first separation container so as to form the helium rich stream;

recovering the liquid stream from the bottom of the first separation container and separating the recovered liquid stream into a liquid nitrogen stream and a first reflux stream;

introducing, as reflux, the first reflux stream into the head of the fractionating column;

introducing the nitrogen rich expanded stream upstream of the second downstream heat exchanger into a second separation container positioned upstream of the first separation container and upstream of the second downstream heat exchanger;

introducing the head stream from the second separation container successively into the second heat exchanger and into the first separation container, wherein the introducing of the head stream from the second separation container into the first separation container is performed without the head stream being expanded in any expansion device; and introducing, as reflux, at least a portion of the bottom stream of the second separation container into the head of the fractionating column, wherein the second introduction stream is introduced in the first downstream heat exchanger without passing through the upstream heat exchanger.

11. A method of producing a liquid nitrogen stream, a gaseous nitrogen stream, a gaseous stream which is rich in helium and a denitrided stream of hydrocarbons from a feed stream which contains hydrocarbons, nitrogen and helium, the method comprising the following steps:

expanding the feed stream in order to form an expanded feed stream;

dividing the expanded feed stream into a first introduction stream and a second introduction stream;

cooling the first introduction stream within an upstream heat exchanger by heat exchange with a gaseous refrigerant stream which is obtained by dynamic expansion in a cooling cycle in order to obtain a first cooled introduction stream;

forming a second cooled introduction stream by cooling, using a first downstream heat exchanger, the second introduction stream;

introducing the first cooled introduction stream and the second cooled introduction stream into a fractionating column which comprises a plurality of theoretical fractionating stages;

tapping at least one reboiling stream and circulating the reboiling stream in the first downstream heat exchanger in order to cool the second introduction stream;

tapping, at a bottom of the fractionating column, a bottom stream which forms the denitrided stream of hydrocarbons;

tapping, at a head of the fractionating column, a head stream which is rich in nitrogen;

reheating the head stream by at least one second downstream heat exchanger in order to form a reheated stream which is rich in nitrogen;

tapping and expanding a first portion of the reheated stream in order to form the gaseous nitrogen stream;

compressing a second portion of the reheated stream in order to form a compressed, recycled nitrogen stream, and cooling the compressed, recycled nitrogen stream by circulation through the first downstream heat exchanger and/or each second downstream heat exchanger;

liquefying and partially expanding the recycled nitrogen stream in order to form an expanded nitrogen rich stream;

introducing at least a portion obtained from the expanded nitrogen rich stream into a first separation container;

recovering the gaseous head stream from the first separation container in order to form the helium rich stream;

recovering the liquid stream from the bottom of the first separation container and separating the recovered liquid stream into a liquid nitrogen stream and a first reflux stream;

introducing, as reflux, the first reflux stream into the head of the fractionating column;

introducing the nitrogen rich expanded stream into a second separation container positioned upstream of the first separation container;

introducing the head stream from the second separation container into the first separation container, wherein the introducing of the head stream from the second separation container into the first separation container is performed without the head stream being expanded in any expansion device;

introducing, as reflux, at least a portion of the bottom stream of the second separation container into the head of the fractionating column;

separating the bottom stream of the second separation container into a second reflux stream that is introduced into the fractionating column and a supplementary cooling stream;

mixing the supplementary cooling stream with the nitrogen rich head stream; and thereafter introducing the supplementary cooling stream and the nitrogen rich head stream mixture into the second downstream heat exchanger.

* * * * *